United States Patent [19]

Schmaeng

[11] 4,021,295

[45] May 3, 1977

[54] METHOD AND APPARATUS FOR SUPPLYING WHITE WATER FROM A SINGLE SILO IN THE FORMATION OF A MULTI-PLY WEB

[75] Inventor: John F. Schmaeng, Rockton, Ill.

[73] Assignee: Beloit Corporation, Beloit, Wis.

[22] Filed: May 5, 1975

[21] Appl. No.: 574,606

[52] U.S. Cl. ..... 162/125; 162/190; 162/198; 162/259; 162/263; 162/264; 162/343; 162/380

[51] Int. Cl.[2] ..... D21F 1/06; D21F 1/66; D21F 11/04

[58] Field of Search ..... 162/123, 125, 126, 127, 162/128, 129, 130, 131, 132, 133, 190, 198, 203, 212, 259, 262, 263, 264, 298, 299, 301, 303, 304, 343, 380

[56] References Cited

UNITED STATES PATENTS

| | | | |
|---|---|---|---|
| 2,059,184 | 10/1936 | Kutter | 162/264 X |
| 3,165,439 | 1/1965 | Lejeune et al. | 162/343 X |
| 3,598,696 | 8/1971 | Beck | 162/343 X |
| 3,620,914 | 11/1971 | Rocheleau | 162/198 |
| 3,839,143 | 10/1974 | Suckow | 162/123 |

*Primary Examiner*—S. Leon Bashore
*Assistant Examiner*—Richard V. Fisher
*Attorney, Agent, or Firm*—Dirk J. Veneman; Gerald A. Mathews; Michael L. Gill

[57] ABSTRACT

The discharge pipes of a plurality of stock pumps, each supplying a separate concentrated stock slurry, are connected with a pipe containing comparatively dilute stock, commonly called "white water", discharged under pressure from a single fan pump on a single white water silo to supply separate slurries to separate chambers of a multi-ply web forming machine. The stock pumps have smaller capacities and pressure heads compared with a fan pump, thereby providing increased efficiency at required capacity with the minimum of equipment.

10 Claims, 2 Drawing Figures

METHOD AND APPARATUS FOR SUPPLYING WHITE WATER FROM A SINGLE SILO IN THE FORMATION OF A MULTI-PLY WEB

BACKGROUND OF THE INVENTION

This invention relates to the equipment for supplying separate slurries of fibrous stock to the separate chambers of a multi-ply fibrous web former such as disclosed in U.S. Pat. Nos. 3,598,696, 3,839,143 and 3,923,593, all of which are assigned to the assignee of this application. Such formers pertain to the substantially simultaneous formation of a multi-ply fibrous product, such as paper board, on a paper making machine.

Historically, multi-ply paper board has been manufactured on cylinder-type machines wherein each layer is applied sequentially to a previously formed web layer to build the composite board up to the required thickness. Each cylinder vat is provided with its own pump to form a new layer on the oncoming web.

In order to produce paper board faster, formers such as disclosed in the aforementioned patents have been conceived and each of the chambers to make the separate layer of the product has been supplied with separate stock supply equipment, including separate white water silos, fan pumps and related piping.

Such fan pumps are commonly used in the manufacture of single ply paper to supply the headbox, or "former", as high pressure hydraulic headboxes are sometimes called, with a water-fiber slurry composed of about 0.5 per cent fibers. Thus, to manufacture a paper web at speeds up to 5,000 fpm, or greater, a fan pump having a large capacity and which consumes large amounts of power is required.

However, simultaneously pumping the stock slurry for each ply of a multi-ply web with a separate fan pump greatly increases the operating expenses and initial capital requirements. Often, in a three layer composite web, the inner layer may comprise a relatively cheap, low strength, high bulk material containing recycled fibers, ash and coating residue while the outer layers are comprised of high strength, virgin fibers. Thus, heretofore, it was considered necessary to supply separate equipment, including motors, fan pumps and white water silos, for each of the various plies produced in a multi-ply former.

SUMMARY OF THE INVENTION

This invention permits the formation of a multi-ply web composed of plies made of stock slurries having different physical properties, or consistencies, without requiring a complete separate set of equipment for each ply. The multiple plies may be formed from a single multi-stage header, such as shown in the U.S. Pat. No. 3,839,143, or successively, such as on a fourdrinier-type machine wherein the various plies are formed with secondary headboxes in a manner well understood by those skilled in the art and illustrated, for example, in U.S. Pat. No. 2,821,120.

In a three ply paper board sheet, the inner ply is commonly referred to as "filler" because it is comprised of cheaper materials which do not necessarily have good strength or printing properties. The outer layers, commonly called "liners", are composed of a higher quality of fibrous material for greater strength and printability. The outer layers may be of the same material.

A stock chest containing a relatively concentrated slurry of fibers and water (i.e. about 3–5% fiber and filler, if any,) is provided for each type of material which will comprise a ply in the composite web to be formed. A single silo containing white water is linked to the low pressure inlet side of a fan pump. A smaller pump links each stock chest with a high pressure outlet header from the fan pump. The now diluted stock from each stock chest is passed through a screen and to either a separate channel in a multichannel hydraulic headbox or to separate headboxes, as the case may be.

Thus, by introducing relatively concentrated stock to the high pressure side of the fan pump, only one fan pump, fan pump motor and white water silo is needed to dilute the stock to the consistency at which the web is formed (usually about 0.9 – 1.0%, wet basis) for a plurality of different web plies.

The need for multiple white water silos, fan pumps and the related motors and piping is completely eliminated. The use of more than one of these items is also unnecessary since by linking the relatively low capacity, high stock fiber concentration stock chest pumps with the outlet side of the fan pump, both the head and volumetric capacity required in the total system are provided. The fan pump head is greater than the sum of the stock chest pump heads to insure flow of the merged streams of all the pumps in the downstream direction through the screens to the former.

Accordingly, it is an object of the invention to provide a stock delivery system for a multi-ply web forming machine having only one white water silo and fan pump.

Another object of the invention is to provide a stock delivery system for a multi-ply web forming machine wherein the pumps delivering stock from the stock chests have relatively low capacity, compared to the fan pump, and are connected with a system feeding the formers on the high pressure outlet side of the fan pump.

An advantage of this invention is elimination of the cost of more than one white water silo, the corresponding fan pumps and their cost of operation.

These and other objects, features and advantages of the invention will be apparent when the description of the preferred embodiments are read in conjunction with the attached drawings.

DESCRIPTION OF THE PREFERRED EMBODIMENTS

Figure 1:
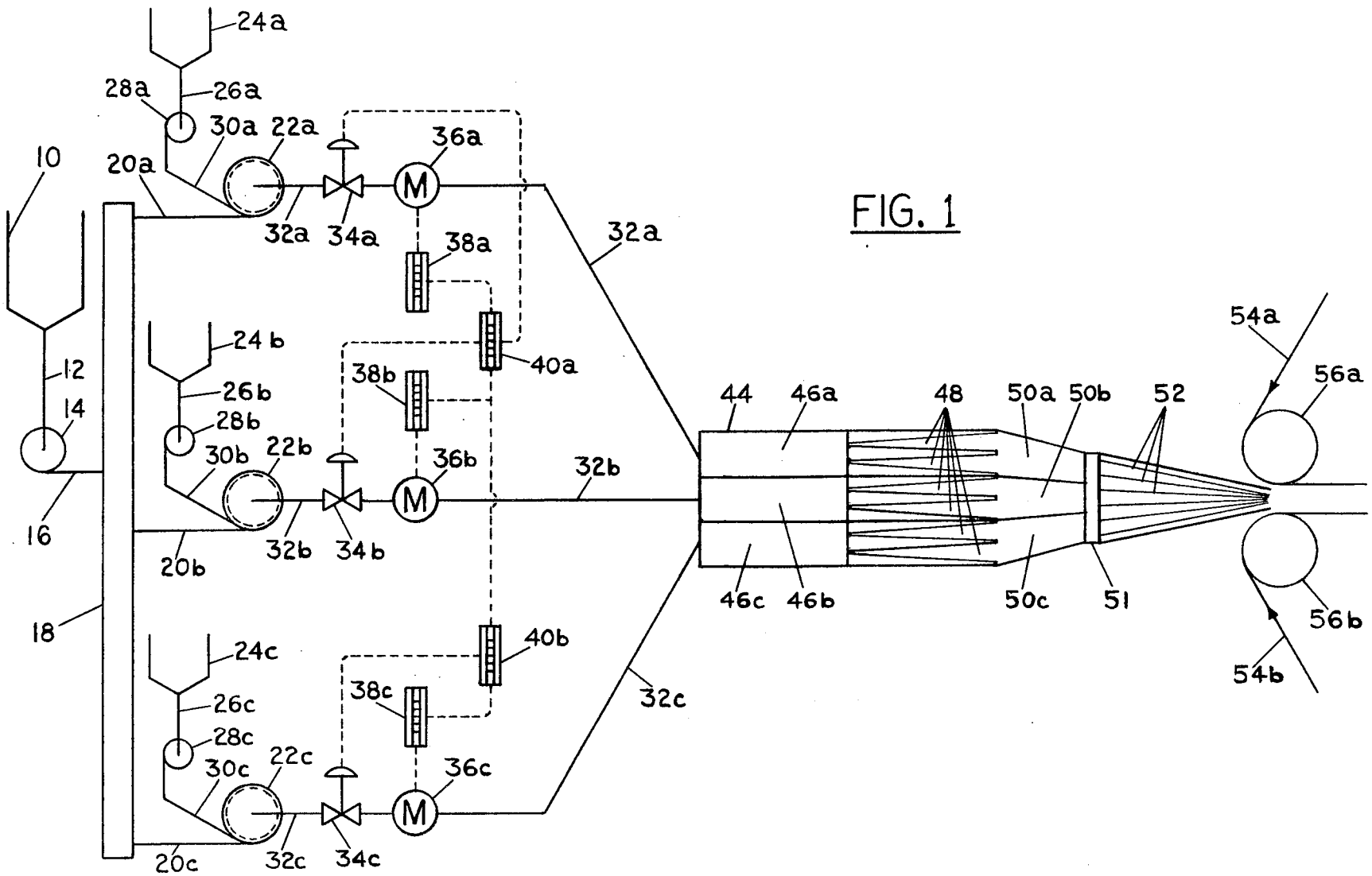
FIG. 1 is a schematic drawing showing the configuration of a stock supply system feeding stock into an integral, three channel, three ply, web former.
Figure 2:
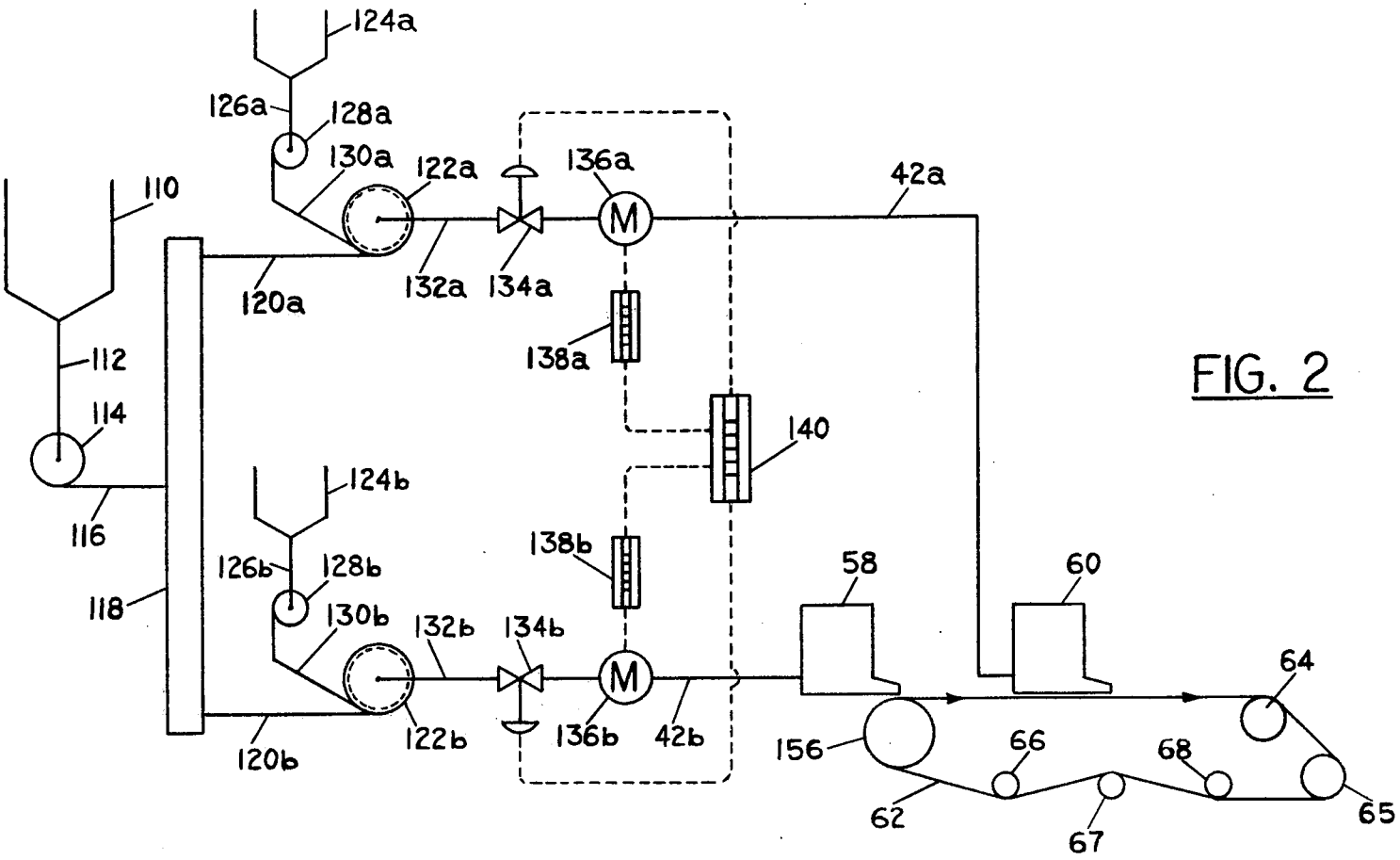
FIG. 2 is a schematic drawing showing the configuration for a stock supply system for feeding stock into a conventional headbox and a secondary headbox on a fourdrinier configuration.

The two preferred embodiments of the invention shown in FIGS. 1 and 2 utilize many of the same components and some items are repeated within each embodiment. Therefore, within each embodiment, corresponding parts are differentiated by an alphabetical subscript. Corresponding parts between the embodiments are differentiated by use of the 100 series of numerals in the embodiment shown in FIG. 2.

As shown in FIG. 1, white water stored in silo 10 is fed via pipe 12 to fan pump 14 where it is pressurized and introduced into manifold 18 through pipe 16. The manifold serves to distribute the white water under pressure to spaced locations where it can enter manifold outlet pipes 20*a–c* leading into stock screens 22*a–c*.

The embodiment shown in FIG. 1 is especially adapted to provide the stock feeding system for the formation of a three ply paper board having its outer layers composed of a high strength liner which may have other special qualities, such as color and opacity, for better printability. Liner stock generally has a high proportion of virgin wood fibers. The inner layer of such a composite web is comprised of filler stock, which is often made up of recycled paper and paper board which inherently has shorter fibers due to the re-refining process and also contains impurities, such as ash, clay coating and ink.

Stock chests 24*a, c*, containing liner stock, and chest 24*b*, containing filler, are linked with stock pumps 28*a–c* via pipes 26*a–c*. Stock pumps 28*a–c* are of considerably smaller volumetric capacity than fan pump 14 since the fan pump must pump white water having a fiber content of about 0.1 – 0.2%, wet basis, whereas the stock pumps pump stock having a fiber content of about 4%, wet basis. Of course, these relative fiber concentrations may vary greatly depending on the type of paper board being manufactured and the white water recovery system. Therefore, these figures are given by way of example of the relative concentrations and are not for the purpose of defining the limits of these ranges. Basically, the white water is free of stock fibers from a practical standpoint and the fibers used in the manufacture of paper board are supplied by the stock chest through the stock pumps.

Stock from the stock pumps is introduced into the screens 22*a–c* through pipes 30*a–c* where it is cleaned and blended with the white water to the desired concentration for formation of the paper board web. concentration of the fibers in the water is in the range of 0.9 –1.0%, wet basis. The hydraulic pressure supplied by the fan pump prevents stock from the stock chests from backing up into the white water manifold. The fiber content of the stock discharged from the cleaners can be controlled by regulating the consistency of the stock in the stock chests or varying the discharge volume of the stock pumps, or both.

Stock of the proper consistency is discharged from the screens through pipes 32*a–c*, through control valves 34*a–c*, meters 36*a–c* and to the three channel hydraulic former 44 via pipes 32*a–c*.

As the speed of the paper board machine increases or decreases, it is important that the stock feeding into the separate channels 46*a–c* of the former increase of decrease proportionally at the same time. In most situations, the volumetric flow in each channel 46*a–c* would be the same. When the various layers are of different materials, or consistencies, the various flow rates may well be different. Naturally whatever ratio is selected between the various flow rates in channels 46*a–c*, it would be desirable to maintain this ratio as the web making machine increases or decreases. For this purpose, flow meters 36*a–c* are electrically connected (shown with dashed lines) to flow sensors 38*a–c* to measure the volumetric flow through pipes 32*a–c*. The flow through pipes 32*a, b* and 32*b, c*, are thus electrically compared by flow ratio controllers 40*a, b*, which are in turn electrically linked each other. The ratio controllers 40*a, b* make certain that the flow rates in all pipes 32*a–c* are either equal or are of the proper predetermined ratio and increase or decrease by the same amount, or ratio, at the same time by activating control valves 34*a–c* to ease or retard the flow rate through the pipes in response to the signals received from flow sensors 38*a–c*.

The three stock flows are delivered to three corresponding separate chambers 46*a–c* of the former where the flow is smoothed out passing through a plurality of expansion tubes 48, into converging chambers 50*a–c*, through a perforated plate 51 and out of the former through a plurality of self-positionable trailing elements 52. Thus, a single former can produce a multi-ply composite web. In many modern paper making machines, the stock slurry is projected between a pair of traveling foraminous wires 54*a, b* which are turning about a pair of rolls 56*a, b* to start the web making process.

It is anticipated that under some circumstances, such as when stock to be supplied to the outer layers is identical, the system could have only two stock chests, stock pumps and related screens and pipes. The output of one stock pump could then be split after the screen to be introduced via separate pipes to corresponding outer chambers 46*a, c* of the former.

FIG. 2 illustrates a system supplying the headboxes and a traditional headbox-fourdrinier paper making machine configuration. The operation of the system is essentially identical to that just described except that only two stock chests 124*a, b* are used with the output delivered to the main headbox 58 and a secondary headbox 60 which deposits a second layer of stock on the initial layer previously deposited by the first headbox. Dewatering is then effected through the fourdrinier wire 62 in any of a number of ways well known to those skilled in the art. The formed web is removed from the wire between rolls 64, 65 and the wire is guided about an endless loop by rolls 66, 67, 68.

It is anticipated that the two stock slurry arrangement shown in FIG. 2 could be used to supply a two channel hydraulic former of the type as shown in FIG. 1, as well as cylinder formers (i.e. the so-called Stevens type) and multiply fourdrinier formers of the so-called Inverform type. Further, the delivery system could be used for the manufacture of webs other than paper board, such as artificial paper and other nonwoven material.

Thus, it is seen that by introducing the relatively concentrated fibrous pulp stock after the fan pump, the proper stock fiber concentration is achieved in each of the plurality of pipes leading to the separate web layer formation chambers or headboxes without the necessity of having a separate white water silo and fan pump for each of the web layers to be formed. In addition, the system permits the formation of a composite layered web wherein each of the layers can be of a different composition, or consistency, as desired.

What is claimed is:

1. In a stock delivery system for the manufacture of a composite multi-ply web from a plurality of separate streams of liquid containing fibers, the combination comprising:

a single silo for supplying white water;

a single fan pump, having high and low pressure sides, for withdrawing white water on the low pressure side thereof from the silo and supplying it from the high pressure side thereof;

a plurality of screening means;

conducting means for receiving the white water from the high pressure side of the fan pump, including a plurality of separate conduits, and conducting the white water to each of the screening means;

a plurality of stock chests containing a supply of fibers in liquid suspension;

a plurality of stock chest pumps for delivering stock under pressure to the plurality of separate conduits on the high pressure side of the fan pump to pass stock through each of the screening means with the white water; and a plurality of conduit means for receiving the separate streams of white water diluted stock from the plurality of screening means and conveying them to a plurality of separate web forming means.

2. A stock system constructed in accordance with claim 1, wherein:

the volumetric capacity of each stock chest pump is less than that of the fan pump.

3. A stock system constructed in accordance with claim 1, wherein:

each stock chest is in fluid communication with a corresponding one of the separate conduits receiving white water from the fan pump.

4. A stock system constructed in accordance with claim 1, wherein:

there are three stock chests in fluid communication with corresponding three chambers of a hydraulic former whereby a three layer composite web can be formed simultaneously.

5. A stock system constructed in accordance with claim 1, wherein:

the plurality of separate web forming means comprises a hydraulic headbox having separate chambers therein for receiving separate streams from the screening means of stock.

6. A stock system constructed in accordance with claim 1, wherein:

the plurality of separate web forming means comprises separate headboxes, each receiving a separate stream of stock from the screening means.

7. A stock supply system constructed in accordance with claim 1, further including:

flow control means connected to each of the separate conduit means, including means for sensing the flow volume therethrough, means for comparing the flow volume in each of the separate conduit means and means for regulating the flow so that the flow in each separate conduit means is of the desired volume or ratio.

8. A stock system constructed in accordance with claim 7, wherein:

the flow control means comprises a control valve in each of the conduit means leading from the screening means, sensor means linked with these conduit means to sense the flow therethrough and, further including, flow ratio control means for comparing the flow through these conduit means and means activating the control valves to apportion the predetermined relative flow through the conduit means.

9. A method of delivering separate streams of liquid containing fibers for use in forming a composite multiply web comprised of layers formed from the separate streams comprising the steps of:

1. providing a single source of pressurized white water and dividing it into a plurality of separate streams;
2. providing a plurality of sources of pressurized stock comprising liquid containing fibers;
3. introducing each source of stock into the separate streams of white water downstream of the single source thereof whereby the combined flows in each separate stream continue to flow downstream;
4. simultaneously separately screening each of the different streams of stock mixed with the white water in a screening means; and 5. conducting each of the separate streams of stock from its screening means to a web forming means to produce the multi-ply web.

10. The method as set forth in claim 9, further including, between the fourth and fifth steps, the steps of:

6. measuring the flow rate in each of the separate stock streams; and
7. controlling the flow rate by comparing the volumetric flow rates in the separate streams and adjusting the volumetric flow rate in each stream to be in accord with predetermined ratios of volumetric flow rates between separate streams.

* * * * *

UNITED STATES PATENT AND TRADEMARK OFFICE

CERTIFICATE OF CORRECTION

PATENT NO. : 4,021,295

DATED : May 3, 1977

INVENTOR(S) : John F. Schmaeng

It is certified that error appears in the above-identified patent and that said Letters Patent are hereby corrected as shown below:

Column 5, lines 33 and 34, please change "from the screening means of stock" to read --of stock from the screening means.--.

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*